United States Patent [19]

Clinard et al.

[11] 4,368,460

[45] Jan. 11, 1983

[54] DUAL MODE MOVING TARGET SENSOR

[75] Inventors: Glenn G. Clinard, Upland; Kenneth C. Guth, Pomona; Gail R. Mulhollam, Upland, all of Calif.; Frank J. Volk, Hickory Hills, Ill.

[73] Assignee: The United States of America as represented by the Secretary of the Air Force, Washington, D.C.

[21] Appl. No.: 314,644

[22] Filed: Dec. 13, 1972

[51] Int. Cl.[3] ..... G08B 13/18

[52] U.S. Cl. ..... 340/522; 340/552; 340/566; 343/5 PD

[58] Field of Search ..... 343/5 PD; 340/258 R, 340/258 B, 522, 552, 566

[56] References Cited

U.S. PATENT DOCUMENTS

| | | | |
|---|---|---|---|
| Re. 25,100 | 12/1961 | Chapin | 343/5 PD X |
| 3,573,817 | 4/1971 | Akers | 340/258 R X |
| 3,717,864 | 2/1973 | Cook et al. | 340/258 R X |
| 3,727,216 | 4/1973 | Antonio | 343/5 PD |

*Primary Examiner*—T. H. Tubbesing

*Attorney, Agent, or Firm*—Donald J. Singer; Julian L. Siegel

[57] ABSTRACT

A dual mode sensor having a seismic channel and an RF channel with a logic circuit recognizing both channels. The seismic channel detects disturbances with a geophone and determines the spacing and the density of the impulses while the RF channel radiates electromagnetic energy and detects impedance changes in the oscillator circuit driving the antenna when the target is in the field. The rates of changing impedances and their thresholds are determined.

1 Claim, 8 Drawing Figures

DUAL MODE MOVING TARGET SENSOR

CROSS REFERENCE TO RELATED APPLICATIONS

An element included in the present invention (outgoing target/inner boundary detector) is explained in detail in our copending application entitled, "PULSE ANALYZER FOR AN RF MOVING TARGET DETECTOR", filed on Dec. 13, 1972, and having Ser. No. 314,645, now U.S. Pat. No. 3,965,470.

BACKGROUND OF THE INVENTION

This invention relates to target detection devices, and more particularly to a moving target sensor using a seismic channel and an RF channel.

In the past, many detectors of moving targets have been used but these detectors are subject to false alarms from motions of objects other than the desired targets such as wind, rain, thunder, or moving animals. The present invention offers a highly sensitive target sensor that can determine if the target is a man, a vehicle, or the like.

SUMMARY OF THE INVENTION

The sensor system of the present invention employs two independent sensor channels, a seismic channel 11 and an RD or electromagnetic channel. Both channels are specifically designed to accept certain targets and reject other channel disturbances due to other sources which are considered false alarms. Each channel consists of a sensing device, signal-processing circuits, and target recognition circuits and a dual-mode control logic circuit to compare the two channels.

It is therefore an object of this invention to provide a detector for a moving target.

It is another object to provide a target sensor using both seismic detection and RF detection.

It is still another object to provide a highly sensitive and accurate dual mode target detector having a low false alarm rate from objects or conditions not of interest.

These and other advantages, features and objects of the invention will become more apparent from the following description taken in connection with the illustrative embodiments in the accompanying drawings, wherein:

DESCRIPTION OF THE DRAWINGS

FIG. 7 is a timing diagram for the RF channel digital signal processor useful in the explanation of the invention.

DETAILED DESCRIPTION OF THE PREFERRED EMBODIMENT

In the following discussion of a preferred embodiment numerical values are given as examples. However, it is understood that these values do not limit the scope of the invention.

Figure 1:
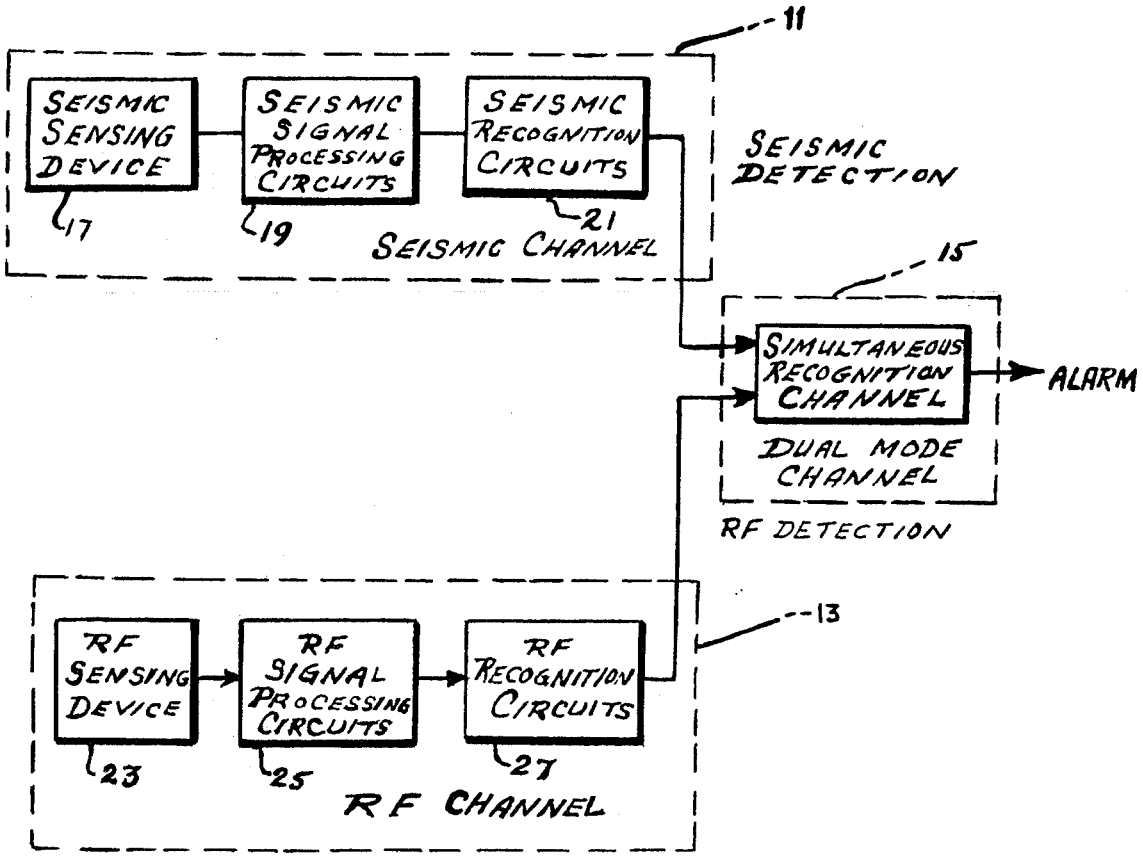
FIG. 1 is a block diagram showing the dual mode sensor concept.

Referring to FIG. 1, there is shown a simplified block diagram of the invention. Two channels, seismic channel 11 and RF channel 13, feed simultaneous recognition channel 15 which determines if a signal or alarm should be generated. Seismic channel 11 includes sensing device 17, signal processor 19, and recognition circuit 21. RF channel 13 includes RF sensor 23, signal processor 25, and recognition circuit 27.

Figure 2:
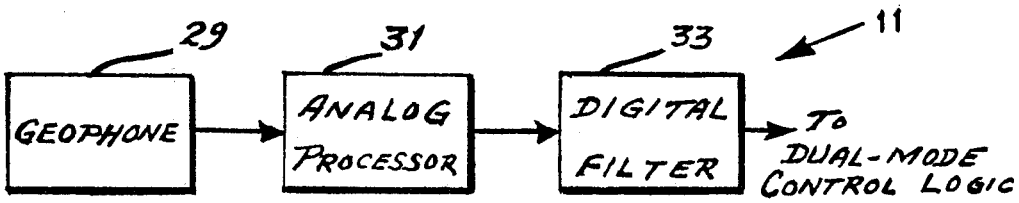
FIG. 2 is a block diagram showing the seismic channel.

The function of the seismic channel is to detect earth vibrations and determine if these vibrations originate from the movement of a man or other object of interest. The seismic channel consists of three subsections shown in FIG. 2 which include geophone 29, analog processor 31, and digital filter 33. Geophone 29 is a transducer which converts displacement velocity to voltage. Analog processor 31 amplifies the output voltage of geophone 29 only within the frequency range of man's footstep energy spectrum. The output from analog processor 31 is a pulse whose width is equivalent to the period of time that energy is present from man's footstep. Digital filter 33 processes this pulse to determine if it originated from the movement of man.

Figure 3:
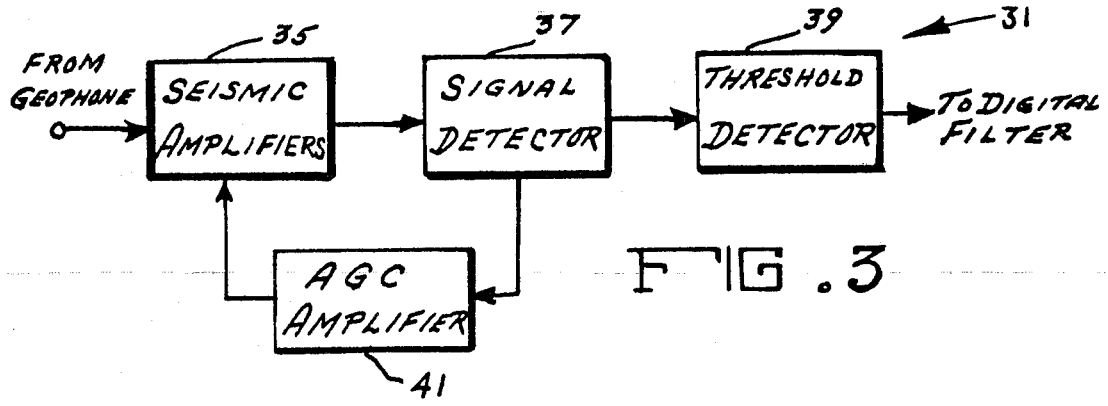
FIG. 3 is a block diagram showing the seismic channel analog processor shown in FIG. 2.

The analog processor shown in FIG. 3 amplifies the output of geophone 29 in amplifiers 35 by an amount dependent on the background noise level. When increases of energy in the frequency passband are received, threshold detector 39 is triggered. Automatic gain control circuit 41 is used to maintain amplifier 35 in the linear region.

Figure 4:
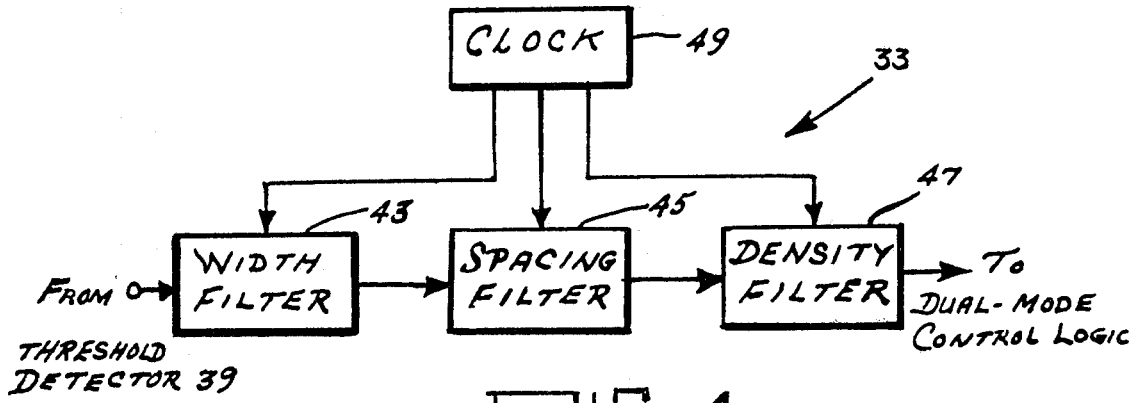
FIG. 4 is a block diagram of the seismic channel digital filter shown in FIG. 2.

As shown in FIG. 4, the output of threshold detector 39 is fed to width filter 43 of digital filter 33 which evaluates the width of the threshold pulse. If the width is correct, a pulse called Good Width (GW) will be generated. If the width is too narrow or too wide, a pulse called Bad Width (BW) will be generated. The interval of time from one good width pulse to the next is then evaluated by spacing filter 45. If the interval is within acceptable limits and no Bad Width pulses have occurred between the Good Width pulses, a Good Spacing pulse will be generated. Good Spacing pulses are counted by density filter 47 up to a maximum count of six. Density filter 47 counts down one count, subsequent to each two-second interval in which a Good Spacing pulse has not occurred until a minimum count of zero is reached. When density filter 47 counts up to four, a Seismic Man Present (SMP) indication occurs. The Seismic Man Present signal is a level change out of the density filter which indicates that a man is present within a given radius of the sensor. This signal is applied to the dual mode control logic. Clock 49 controls the timing of the above-mentioned circuits.

The analog section can use low power, monolithic, operational amplifiers. The digital filter can use monolithic complementary MOS logic elements which are applicable to large scale integration and low power consumption.

The function of the RF channel is to detect a man target moving within the electromagnetic influence field of the RF antenna.

Figure 5:
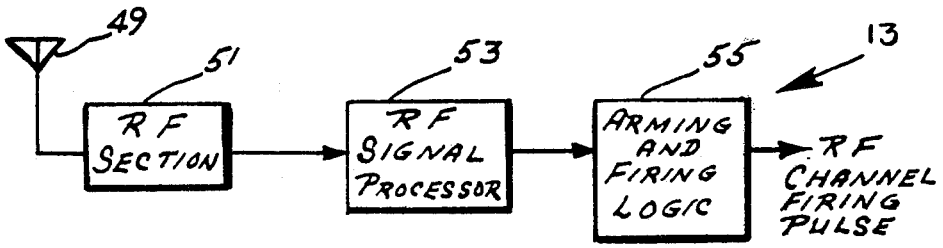
FIG. 5 is a simplified block diagram of the RF channel.

The RF channel consists of three basic subsections as shown in FIG. 5 which include antenna 49, RF section 51, RF signal processor 53, and arming and firing circuit 55.

Figure 6:
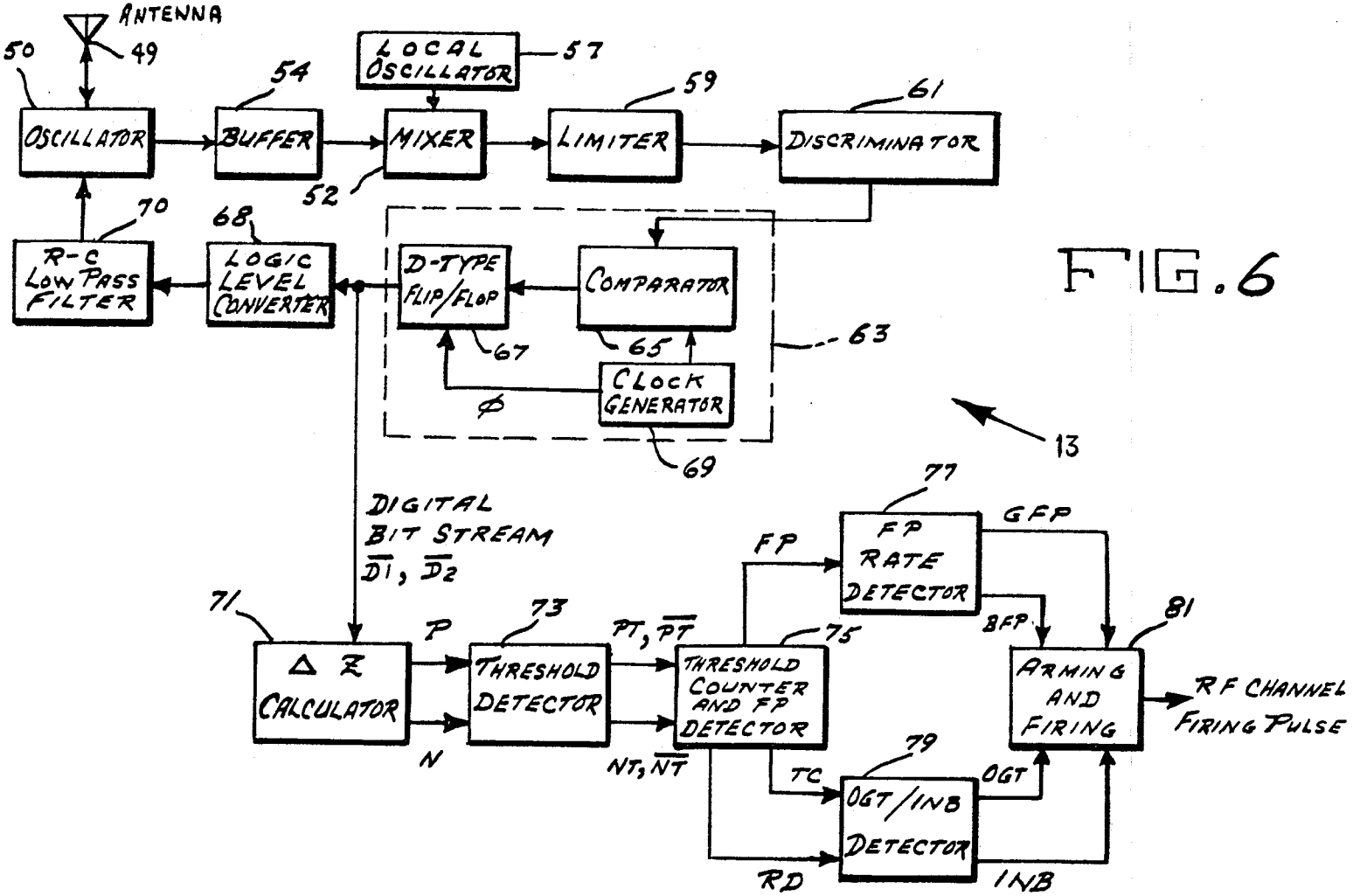
FIG. 6 is the overall block diagram of the RF channel.

The RF section is shown in block diagram form in FIG. 6. A 62.5 MHz impedance controlled oscillator 50 causes electromagnetic energy to be radiated from antenna 49 connected in its feedback loop. The output of impedance controlled oscillator 50 is applied to frequency mixer 52 through buffer amplifier 54. The output of a 63.5 MHz crystal controlled oscillator 57 is also applied to mixer 52. Thus, the output of mixer 52 is 1 Mz under quiescent conditions. When a man target moves within the electromagnetic field of the antenna, small changes are induced in the impedance of the antenna. These impedance changes cause impedance controlled oscillator 50 to shift up or down in frequency which are caused by the doppler phenomena. The doppler frequency undergoes a 180° phase shift every time the man target advances within the electromagnetic field, a radial distance equal to one quarter of the wavelength of the radiated frequency. Thus, for 62.5 MHz, a frequency shift equivalent to 180° would occur every four feet. These frequency shifts frequency modulate the output of mixer 52 which is amplified by a data amplifier (not shown) and limited in limter 59. The signal is then fed to discriminator 61.

The amplified 1 MHz (nominal) frequency from discriminator 61 is processed in a double balanced mixer 63 which includes comparator 65, flip-flop 67, and clock 69. The double balanced mixer produces data bits $\overline{D1}$, for frequency shifts above 62.5 MHz and $\overline{D2}$ for frequency shifts below 62.5 MHz, proportional in number to the frequency shifts of the impedance controlled oscillator above and below this frequency. The output of flip-flop 67 is fed to logic level counter 68 and then to oscillator 50 via low pass filter 70 to complete the loop. The DC values from lower pass filter 70 bias oscillator 50 and thereby adjust its frequency. The data bits are counted in ΔZ calculator 71. The outputs of ΔZ calculator 71 are labeled P and N, corresponding to a positive and negative change, respectively, in the antenna impedance. The magnitude of the impedance change in the antenna is proportional to the number of data pulses P and N out of the ΔZ calculator 71.

FIG. 7 illustrates how the data pulses on the P and N outputs from ΔZ calculator 71 correspond in time to the dynamic antenna impedance characteristic. As can be seen, pulses will occur on the P output only when the antenna impedance is increasing and conversely, pulses on the N output will occur only when the antenna impedance is decreasing. Each pulse, as shown on the P or N line, is separated by a time equal to the digital integration time, $\tau$. The P and N pulses correspond to the magnitude of the antenna impedance change during the previous time, $\tau$. The digital signals on the P and N outputs from ΔZ calculator 71 can be interrogated further by digital techniques to implement closest point of approach detection and false alarm rejection.

The P and N outputs from the ΔZ calculator are fed into digital threshold detector 73, as shown in FIG. 6, the purpose of which is to generate a pulse each time the antenna impedance changes in magnitude an amount equivalent to one-half the antenna impedance change that a target produces as it moves on a radial path from, as an example, 66 feet to 62 feet (the maximum detection range of interest). The threshold detector is implemented digitally by an up-down counter whose bit length is equal to one-half the number of data pulses present at the output from ΔZ calculator 71 as the target moves from 66 feet to 62 feet. Pulses on the P input are counted in threshold detector 73 (up-down counter) in the up direction and pulses on the N input are counted in the down direction. Each time threshold detector 73 overflows in the up direction (positive threshold crossings) an output pulse is generated on the PT (positive threshold) output from threshold detector 73. Conversely, each time the threshold detector overflows in the down direction (negative threshold crossing), an output pulse is generated on the NT threshold) output from threshold detector 73.

The timing of the pulses on the PT and NT outputs from the threshold detector can be seen by comparing FIGS. 7*a*, 7*b*, and 7*c*. In FIG. 7*a*, as the target moves radially from 66 feet to 62 feet, a number of pulses proportional to this antenna impedance change is generated by the P output of ΔZ calculator 71. These pulses are counted in threshold detector 73 in the up direction and will overflow the threshold detector twice since the bit length of the up-down counter (threshold detector) is equal to one-half the number of pulses present on the P output from ΔZ calculator 71 as the target moves from 66 feet to 62 feet. FIG. 7*c* shows two pulses on the PT (positive threshold) output from threshold detector 73, the second one occurring as the target reaches a range of 62 feet.

As the target moves from 62 to 58 feet (FIG. 7*a*) a number of pulses proportional to this change in antenna impedance are generateed at the N output from ΔZ calculator 71 (FIG. 7*b*) and these pulses are counted in the up-down counter (threshold detector) in the down direction. Since the antenna impedance change from 62 to 58 feet is greater than the antenna impedance change from 66 to 62 feet, the number of pulses present on the N output is greater than the number of pulses that were present on the previous P output. Therefore, in FIG. 7*c*, the second output pulse on the NT output from threshold detector 73 occurs just prior to the target's approach to 58 feet. If this process were allowed to continue, the number of threshold crossing pulses, PT and PN, will increase in number each time the antenna impedance characteristic changes slope.

The outputs of threshold detector 73 are applied to data retiming logic circuit (not shown) which regenerates the PT and NT pulses and their complements $\overline{PT}$ and $\overline{NT}$, respectively. As shown in FIG. 6, the PT, $\overline{PT}$, NT, and $\overline{NT}$ signals are fed to TC/FP detector 75 (threshold counter/frequency pulse detector). The frequency which is being detected here is the frequency (AC component) of the antenna impedance characteristic in FIG. 7*a* which is directly proportional to the radial velocity of the target. TC/FP detector 75 has three outputs which are, in order of discussion, FP (frequency pulse), TC (threshold count), and RD (read pulse). The TC/FP detector can be implemented with two flip-flops and associated AND-gates for decoding.

The FP (frequency pulse) output is the second occurring PT or NT pulse present at the intput to TC/FP detector 75. The second PT or NT pulse is chosen, rather than the first, because the up-down counter in threshold detector 73 can generate randomly one PT pulse followed by one NT pulse just due to noise generated internal or external to the RF signal processor. To avoid detecting false frequency pulses (FP's), the second PT and NT pulses are detected. The occurrence of these frequency pulses can be compared to the antenna impedance characteristic in FIG. 7*a*. The pulse rate frequency (PRF) of the frequency pulses is exactly twice the frequency of antenna impedance characteristics. As a result, further digital processing (interrogation) of the FP output can determine if the velocity of the target falls within the allowable velocity range set at 0.5 to 10 feet per second.

The purpose of the RD (read pulse) and the TC (threshold count) outputs from the TC/FD detector is to achieve a digital signal format which is easily processed further for closest point of approach detection. The RD output pulse from TC/FP detector 75 is the first occurring PT or NT pulse present at the input to this detector. It serves as a signal to note when the antenna impedance characteristic has changed slope. A RD pulse occurs whenever the antenna impedance characteristic changes from increasing to decreasing antenna impedance or from decreasing to increasing antenna impedance. This can be shown by comparing the RD trace in FIG. *7d* with the antenna impedance characteristic in FIG. *7a*.

The TC (threshold count) output from TC/FP detector 75 generates all the PT or NT pulses except the first PT or NT pulse which occurs on the PT and NT inputs to TC/FP detector 75. The first occurring PT or NT pulse is ignored for the same reason as given for the FP (frequency pulse) previously mentioned. The occurrence of these threshold counts with respect to the antenna impedance characteristic can be seen by comparing the TC trace in FIG. *7d* with FIG. *7a*.

The FP's from TC/FP detector 75 are applied to FP rate detector 77. The purpose of FP rate detector 75 is to determine if the frequency associated with the antenna impedance characteristic (target velocity) falls within the boundary corresponding to a man target. The minimum and maximum radial target velocities were chosen to be 0.5 and 10 feet per second, respectively. The minimum target velocity corresponds to an antenna impedance characteristic frequency of 0.5 feet per second times $\frac{1}{8}$ cycle per foot or 0.0625 Hz. The maximum frequency would be 10 feet per second times $\frac{1}{8}$ cycle per foot or 1.25 Hz, but since the frequency of the pulses on the FP input to FP rate detector 77 is twice the frequency of the antenna characteristic, the pulse frequency present at the input to FP rate detector 79 will be 0.125 Hz minimum to 2.5 Hz maximum. This corresponds to a FP spacing range of 8 seconds to 0.4 second on the FP input to FP rate detector 77.

FP rate detector 77 determines if the time spacing between adjacent frequency pulses falls within the 0.4 to 8 second limit. This is accomplished by zeroing and starting a counter with the first frequency pulse. The times corresponding to 0.4 second and 8 seconds are decoded out of the counter. If the second frequency pulse occurs after 0.4 seconds but before 8 seconds, the second frequency pulse is generated by FP rate detector 77 as a good frequency pulse (GFP) and the counter is re-zero'd to start counting again. If the second frequency pulse occurs before 0.4 second following the first frequency pulse, a bad frequency pulse (BFP) is generated by FP rate detector 77 and the counter is re-zero'd to start counting again. If the 8-second decoding pulse from the counter occurs before the second frequency pulse, a bad frequency pulse is also generated by FP rate detector 77 and the counter waits for the next frequency pulse. Therefore, FP rate detector 77 examines the FP input on a pulse-pair basis. Each frequency pulse is used as a "time equal zero" reference for the next frequency pulse. If the next frequency pulse is spaced properly (0.4 to 8 seconds) a GFP is generated. If the next frequency pulse is not spaced properly, a BFP is generated. FP rate detector 77 protects the RF channel from false alarms such as that due to lightning or wind blown vegetation. These natural phenomena generally exhibit an antenna impedance characteristic frequency much higher than that frequency associated with a man target in FIG. *7a* and therefore will cause BFP outputs to occur from FP rate detector 77.

The RD and TC pulses from the TC/FP detector 77 are applied to the OGT/INB detector 79. The purpose of the OGT/INB detector 79 is to determine when the target has passed the closest-point-of-approach or when the target comes to within a predictable minimum range with respect to the antenna. The first output from the OGT/INB detector 79 is the OGT (outgoing target) pulse which occurs when the peak-to-peak amplitude excursions of the antenna impedance characteristics begin to decrease. The second output from the OGT-/INB detector is the INB (inner boundary) pulse which occurs when the target moves to within a predictable minimum range. This OGT/INB detector is explained in detail in our copending application, Ser. No. 314,645, and entitled, "PULSE ANALYZER FOR AN RF MOVING TARGET DETECTOR".

Arming and firing logic 81 constitutes the final block in the RF digital signal processing block diagram of FIG. 6. The inputs are the GFP (good frequency pulse) and the BFP (bad frequency pulse) from the FP (frequency pulse) rate detector 77 and the OGT (outgoing target) and INB (inner boundary) from OGT/INB detector 79. The output of arming and firing logic is the RF channel firing pulse which is fed to dual mode control logic 15 (FIG. 1). The purpose of arming and firing circuit 81 is to pass an OGT pulse or an INB pulse to the output as an RF channel firing pulse providing a certain criterion is met. The criterion, in essence, "arms" arming and firing circuit 81 making it possible to pass an OGT or INB pulse to the output as an RF channel firing pulse. The criterion is determined from the GFP (good frequency pulse) and the BFP (bad frequency pulse) from FP rate detector 77. The criterion will be met, as an example, if at any time three consecutive good frequency pulses without the presence of any bad frequency pulses are generated by FP rate detector 77.

To achieve additional protection against false alarms, the occurrence of an OGT (outgoing target) pulse or an INB (inner boundary) pulse will also reset a latching counter (not shown) to zero if the latchup state has not occurred yet. This protects the RF channel from firing on a false target which may satisfy the velocity requirements of 0.5 to 10 feet per second but causes the peak-to-peak antenna impedance characteristic to increase or decrease too rapidly. This type of false alarm can easily occur due to wind-blown vegetation slowly oscillating back and forth and located at ranges of 8 feet, 12 feet, etc. from the antenna. The rate of change of antenna impedance is maximum at these particular ranges and wind-blown vegetation can cause large excursions in the antenna impedance.

In all cases, after the latching counter in arming and firing logic 81 has reached the latchup state, a bad frequency pulse (BFP), an OGT (outgoing target) pulse, or an INB (inner boundary) pulse is inhibited from resetting or unlatching the latching counter. After latchup (the criterion) occurs, any occurrence of an OGT or INB pulse will be outputted as an RF channel firing pulse to the dual mode control logic.

The choice of three consecutive good frequency pulses as the criteria for arming (rather than 2 or 10, for instance) can be justified in this case by comparing the FP (frequency pulse) trace in FIG. 7*d* to the antenna impedance characteristic in FIG. 7*a*. The FP rate detector compares two adjacent FP's before it can output one good frequency pulse (GFP). Therefore it takes three pairs or four consecutive FP's to output three consecutive good frequency pulses. It can be seen in FIG. 7*a* that only four FP (frequency pulses) exist beyond a range of 50 feet. Therefore, a sufficient number of FP's occur due to a true target before the target approaches the maximum required closest-point-of-approach range of 50 feet.

The output of the arming and firing circuit, together with the output of the seismic channel, is applied to the dual mode control logic 15 as shown in FIG. 1.

Figure 8:
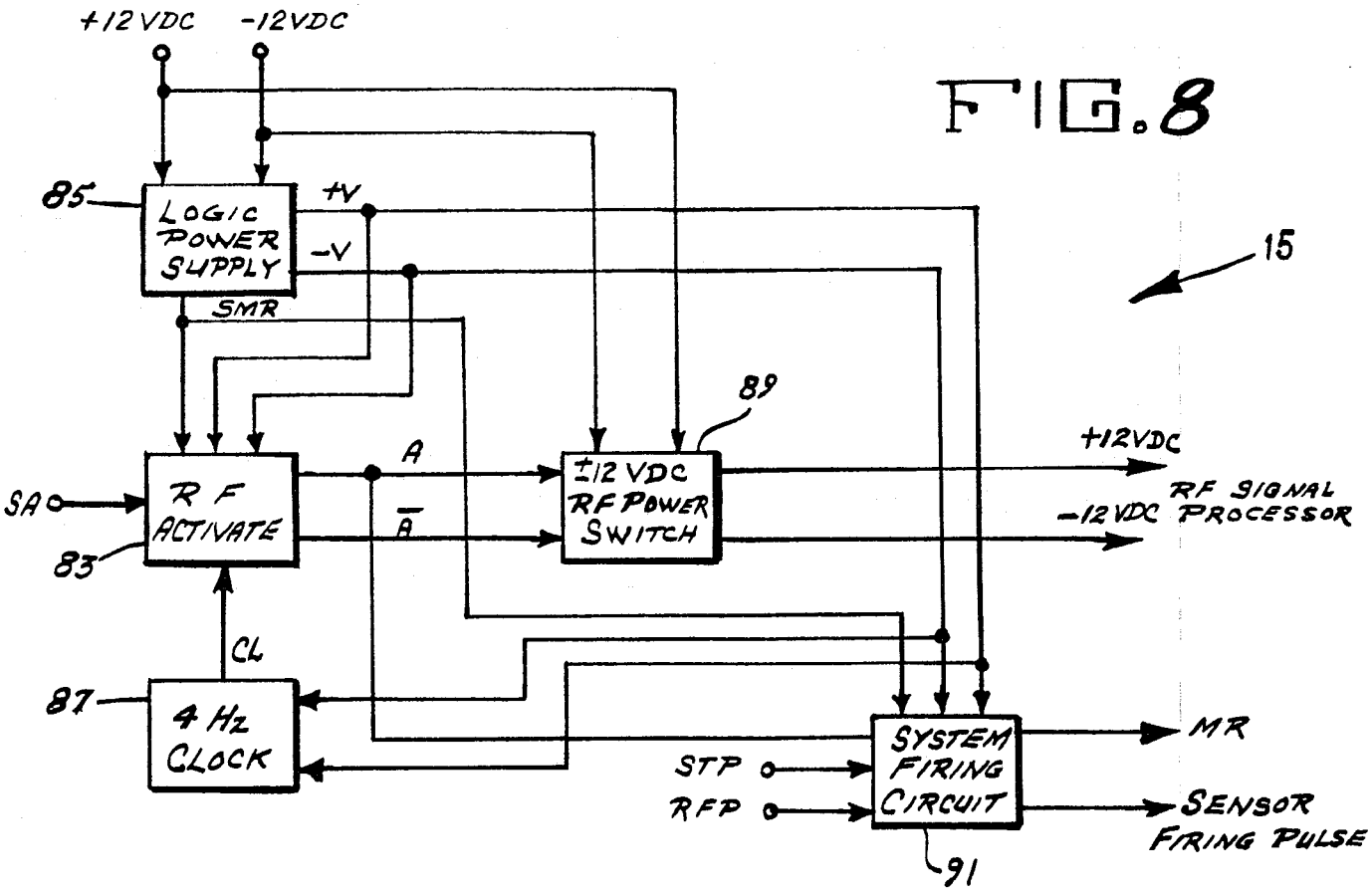
FIG. 8 is a block diagram of the dual mode control logic.

A functional block diagram of the dual mode control logic is shown in FIG. 8. The purpose of this circuit is to activate the RF channel upon command (SA) from the seismic channel, and to generate a system firing pulse (SFP) when a STP and RFP are present simultaneously. The dual mode control logic consists of the following major circuits: RF activate circuit 83; logic power supply 85; 4 Hz clock 87; ±12 VDC RF power switch 89, and system firing circuit 91.

When there is seismic activity SA becomes true, and RF activate circuit 83 drives the RF power switch 89 on and simultaneously causes system firing circuit 91 to generate a master reset (MR) pulse to the RF signal processor. As long as SA is present the RF operates simultaneously with the seismic system. The two systems operating together form the dual mode system. If SA becomes false, power turnoff to the RF channel is delayed by RF activate circuit 83 that controls RF power switch 85. The power turnoff delay prevents the RF channel from being turned on and off erratically when the target is initially being detected by the seismic channel.

The system firing circuit will generate a sensor firing pulse (SFP) if the seismic channel generates an STP signal simultaneously with an RFP signal from the RF channel. To prevent the system firing circuit from generating an SFP when power is initially applied to sensor circuits, a system master reset (SMR) is provided. The SMR automatically resets all the logic circuits when power is initially applied to the sensor.

The RF channel is turned on by seismic activity (SA) and the logic equation for this function is $$RF\ \text{activate} = SA.$$

A sensor firing pulse (SFP) is generated whenever seismic target present (STP) and an RF firing pulse (RFP) were present simultaneously. The logic equation for this function is $$SFP = STP \cdot RFP.$$

RCA series DC 4000 COS/MOS logic gates can be used for the dual mode logic to take advantage of their lower power dissipation.

It is claimed:

1. A moving target sensor comprising:

a. means for detecting seismic disturbances;

b. means for recognizing the detected seismic disturbances having predetermined values, the seismic recognizing means including
   1. a geophone,
   2. a threshold detector fed by the geophone,
   3. a clock,
   4. a width filter fed by the threshold detector and the clock,
   5. a spacing filter fed by the width filter and the clock, and
   6. a density filter fed by the spacing filter and the clock;

c. means for detecting RF disturbance signals including
   1. a radiating antenna,
   2. an impedance controlled oscillator connected to the antenna, the oscillator output being indicative of antenna impedance,
   3. a first mixer fed by the impedance controlled oscillator,
   4. a local oscillator feeding the first mixer,
   5. a discriminator fed by the first mixer,
   6. a double balanced mixer fed by the discriminator producing data bits,
   7. a logic level converter fed by the double balanced mixer, and
   8. a low pass filter fed by the logic level converter and fed back to the impedance controlled oscillator;

d. means for recognizing detected RF disturbance signals having a predetermined value including
   1. means for detecting changes of antenna impedance,
   2. means for detecting thresholds of antenna impedance, and
   3. means for determining the rate of changes of antenna impedance; and e. means for detecting simultaneous occurrences of the outputs of the seismic recognizing means and the RF recognizing means.

* * * * *